US011364508B2

(12) United States Patent
Ćwik

(10) Patent No.: US 11,364,508 B2
(45) Date of Patent: Jun. 21, 2022

(54) ELECTROSTATIC AIR FILTER

(71) Applicant: PRO-VENT Systemy Wentylacyjne Krzysztof Ćwik, Krapkowice (PL)

(72) Inventor: Krzysztof Ćwik, Komprachcice (PL)

(73) Assignee: PRO-VENT SYSTEMY WENTYLACYJNE KRZYSZTOF CWIK, Krapkowice (PL)

( * ) Notice: Subject to any disclaimer, the term of this patent is extended or adjusted under 35 U.S.C. 154(b) by 292 days.

(21) Appl. No.: 16/200,935

(22) Filed: Nov. 27, 2018

(65) Prior Publication Data

US 2019/0160475 A1 May 30, 2019

(30) Foreign Application Priority Data

Nov. 27, 2017 (PL) ..... P 423617

(51) Int. Cl.
*B03C 3/38* (2006.01)
*B03C 3/09* (2006.01)
(Continued)

(52) U.S. Cl.
CPC ..... *B03C 3/38* (2013.01); *B03C 3/011* (2013.01); *B03C 3/025* (2013.01); *B03C 3/06* (2013.01);
(Continued)

(58) Field of Classification Search
CPC ..... B03C 3/38; B03C 3/368; B03C 3/025; B03C 3/06; B03C 3/49; B03C 3/011; B03C 3/60; B03C 3/66; B03C 3/09; B03C 3/12; B03C 3/155; B03C 3/41; B03C 3/47; B03C 2201/28; B03C 2201/04; B03C 3/017; B03C 3/0175
See application file for complete search history.

(56) References Cited

U.S. PATENT DOCUMENTS 4,244,710 A 1/1981 Burger
5,656,063 A 8/1997 Hsu
(Continued)

FOREIGN PATENT DOCUMENTS

CN 102019230 A 4/2011
JP 2005337611 A 12/2005
JP 2006034957 A 2/2006

*Primary Examiner* — Robert Clemente
(74) *Attorney, Agent, or Firm* — Browdy and Neimark, P.L.L.C.

(57) ABSTRACT

An electrostatic air filter connected to a high voltage source, including an air flow channel, an ion generator, at least one corona electrode and at least one cumulative electrode, the corona electrodes and the cumulative electrodes are configured so that corona discharges occur between the corona electrodes and the cumulative electrodes due to a first potential difference, causing ionization of contaminant particles present in the air flow channel. A separator of contaminant particles is disposed in the air flow channel and includes input and output electrodes that enable the flow of air therethrough in a direction away from the input electrode to the output electrode and further to the channel outlet. During operation, there is a first potential difference between the corona and input electrodes and a second potential difference between the input and output electrodes, so that the electric field strength in the space between the input and output electrodes is directed opposite to that in the space between the ion generator and the input electrode.

20 Claims, 6 Drawing Sheets

Figure 1:
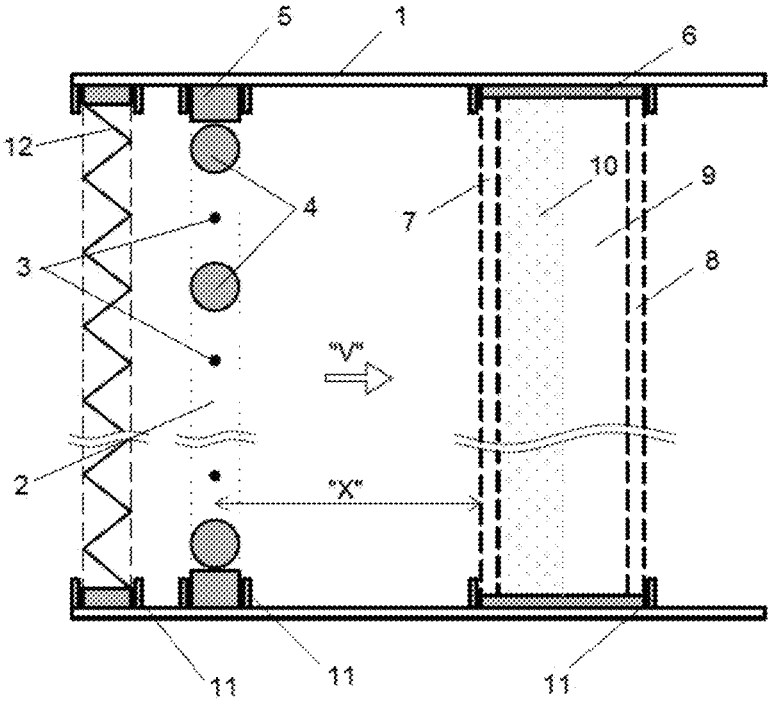

(51) Int. Cl.

| | |
|---|---|
| ***B03C 3/12*** | (2006.01) |
| ***B03C 3/155*** | (2006.01) |
| ***B03C 3/41*** | (2006.01) |
| ***B03C 3/47*** | (2006.01) |
| ***B03C 3/36*** | (2006.01) |
| ***B03C 3/02*** | (2006.01) |
| ***B03C 3/06*** | (2006.01) |
| ***B03C 3/49*** | (2006.01) |
| ***B03C 3/011*** | (2006.01) |
| ***B03C 3/60*** | (2006.01) |
| ***B03C 3/66*** | (2006.01) |

(52) U.S. Cl.

CPC ..... *B03C 3/09* (2013.01); *B03C 3/12* (2013.01); *B03C 3/155* (2013.01); *B03C 3/368* (2013.01); *B03C 3/41* (2013.01); *B03C 3/47* (2013.01); *B03C 3/49* (2013.01); *B03C 3/60* (2013.01); *B03C 3/66* (2013.01); *B03C 2201/04* (2013.01); *B03C 2201/28* (2013.01)

(56) References Cited

U.S. PATENT DOCUMENTS

| | | | |
|---|---|---|---|
| 2014/0076163 | A1 | 3/2014 | Hess |
| 2014/0205495 | A1 | 7/2014 | Ota et al. |
| 2016/0102589 | A1 | 4/2016 | Kim |

ELECTROSTATIC AIR FILTER

The object of the invention is an electrostatic air filter, in particular for ventilation of air.

There is a common necessity to filtrate ventilation air delivered to zones of human presence or for technological purposes. The problem of air contamination, in particular smog, concerns virtually all urbanised areas. Due to the bad condition of the air, the number of people with allergies of atmospheric origin is quickly increasing. Various techniques are used for elimination of undesired components from the air.

It is common knowledge to use mechanical nonwoven, cyclotron, electrostatic and other filters for the removal of solid particles and aerosols. Various absorbers or catalysts, for instance activated carbon or ozone, are used to remove gaseous contaminants.

Mechanical filters are mainly in the form of suitably thick nonwoven mats assembled in the form of flat, pleated or baggy elements.

Electrostatic filters known in prior art use the phenomena of electrostatic attraction and corona discharge which cause ionisation of air.

Many known electrostatic filters are assembled from numerous elements consisting of corona electrodes which cause heavy ionisation of a gaseous medium (e.g. air) and of earthed collecting electrodes. Due to the impact of a strong electric field which is directed transversely to the direction of air flowing through the filter, electrified solid particles and aerosols are deposited on the collecting electrodes. Electrostatic precipitators of this type are used primarily in the industry for the removal of contaminants created in various technological processes, e.g. chimney smoke, etc.

Industrial electrostatic precipitators are unsuitable for ventilation applications for the following reasons:

- in order to achieve successful filtration, an electrostatic precipitator of the described type requires relatively strong ionisation of particles, which results in high emission of electric charges from corona discharges on electrodes causing considerable emission of ozone and nitrogen oxides, which are harmful for humans;
- removal of contaminants accumulated on numerous metal elements from such an electrostatic precipitator requires partial disassembly of the device and complicated servicing for periodic cleaning.

Filters for residential premises operating on the basis of electrostatic precipitation are also known—the so-called "air purifiers"—but their efficiency is low due to the necessity to limit the emission of ozone and nitrogen oxides in the order of 20-50%, which is why they operate on the basis of constant recirculation of air in the given room.

An additional problem of very precise filters involves preventing air leakages in a manner which bypasses the filter. Even minimum leakage in the mounting of the filter causes considerable limitation of the maximum attainable performance.

It was an object of the invention to provide an electrostatic air filter having increased efficiency of filtration in relation to the known filters of this kind; the filter having also high absorbability in order to decrease the frequency of maintenance, as well as a compact construction.

It was an additional objective of the invention to provide a filter which would be easy to service, but in which the unfiltered air would not enter the filter outlet due to leakage.

It was also an object of the invention to provide an electrostatic air filter in which the emission of ozone and nitrogen oxides would be limited.

According to the invention, an electrostatic air filter connected to a high voltage source has been developed, comprising an air flow channel having an inlet and an outlet, in which at the air inlet side there is an ion generator comprising at least one corona electrode and at least one cumulative electrode, the corona electrodes and the cumulative electrodes being electrically connected to each other, while the cumulative electrodes are insulated from the corona electrodes, so that corona discharges may occur between the corona electrodes and cumulative electrodes due to a potential difference, the corona discharges causing ionisation of contaminant particles present in the air flowing through the channel.

The filter according to the invention is characterised in that downstream of the ion generator in the air flow channel a separator of contaminant particles is located, comprising an input electrode and an output electrode spaced apart from the input electrode, both electrodes enabling the flow of air therethrough in a direction away from the input electrode towards the output electrode and further to the channel outlet, and in that during the operation of the filter a potential difference exists between the corona electrodes and the input electrode, and another potential difference exists between the input electrode and the output electrode, so that the electric field strength in the space between the input electrode and the output electrode is directed opposite to the electric field strength in the space between the ion generator and the input electrode.

Preferably, the input electrode and the output electrode have a cylindrical shape, so that the output electrode surrounds the input electrode.

The input electrode is preferably adapted to the deposition of contaminant particles thereon; it is most preferably made of a conductive nonwoven or a spongiform material, optionally coated with activated carbon.

Preferably, a filter layer made of a material with low electrical conductivity is located in the space between the input electrode and the output electrode there is.

Preferably, the potential of the corona electrodes and the output electrode is positive, while the potential of the input electrode equals zero.

Optionally, the potential of the corona electrodes and the output electrode is positive, while the potential of the input electrode is negative.

The potential of the corona electrodes and the output electrode may also be negative, while the potential of the input electrode may equal zero.

Possibly, the potential of the corona electrodes and the output electrode is negative, while the potential of the input electrode is positive.

Preferably, the potential of the corona electrode is positive, the potential of the input electrode is negative, while the potential of the output electrode equals zero.

In another embodiment, the potential of the corona electrode may be negative, the potential of the input electrode may be positive, while the potential of the output electrode may equal zero.

Preferably, the air flow channel constitutes a filter housing in which the ion generator and the particle separator are assembled in a manner which is tight and enables the disassembly of the ion generator and the separator for servicing purposes.

Preferably, in the channel housing, between the guides in which the separator is seated, there is at least one opening connecting the space between the guides and the separator to the external surroundings.

Preferably, the filter comprises a pre-filter upstream of the ion generator, for mechanical separation of contaminant particles.

Preferably, the potential difference between the corona electrodes and the cumulative electrodes is adjustable and ranges between 2 and 80 kV.

Preferably, the potential difference between the corona electrodes and the input electrode is greater than the potential difference between the corona electrodes and the cumulative electrodes.

The input electrode and/or the output electrode may have the form of a mesh or perforated sheet metal, possibly of a surface with ribs or folds, or in the form of segments situated at an angle with respect to each other.

Preferably, the potential difference between the input electrode and the output electrode is adjustable and ranges between several and several dozen kV, preferably between 2 and 50 kV.

Preferably, the filter comprises at least two corona electrodes which are connected to each other in series.

In a preferable embodiment, the corona electrodes are in the form of discs and they are placed on an insulator which is preferably located in the shield.

Preferably, the input electrode is rotary, the output electrode comprises a slit, while the insert of the filtering layer is movable on the surface of the rotating input electrode, so that its ends extend through said slit, which enables its replacement.

The primary advantage of the air filter according to the invention is that due to the use of the separator of contaminant particles, relatively small corona discharges occurring in the ion generator are sufficient to achieve effective filtration. This is of great significance since the corona discharges are always accompanied by the undesired production of ozone and nitrogen oxides, as well as electromagnetic disturbance. The ozone and nitrogen oxides, which are created in known industrial electrostatic precipitators, are harmful to the human health and deteriorate the quality of air. In the filter according to the invention, more efficient electrification of solid particles occurs due to the additional impact-based electrification of ions originating from the corona discharge occurring within the space between the corona and cumulative electrodes and the input electrode, while the remaining free ions are slowed down in the separator and remain in a longer contact with the solid particles, enabling their more efficient electrification.

Figure 2:
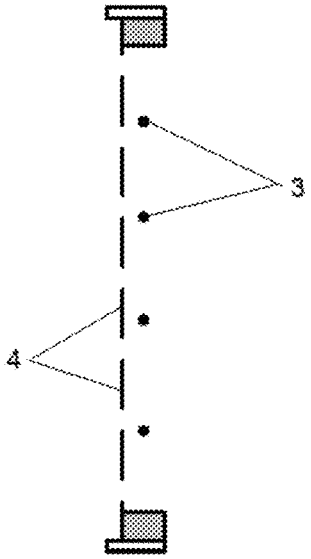
Figure 3:
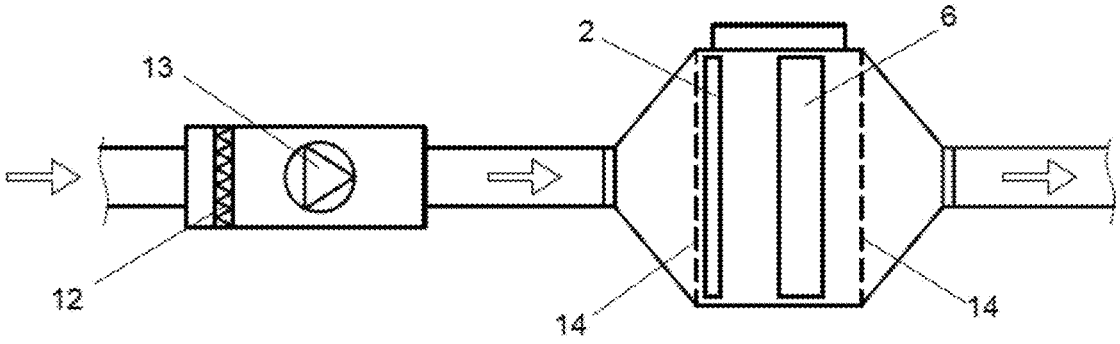
Figure 4:
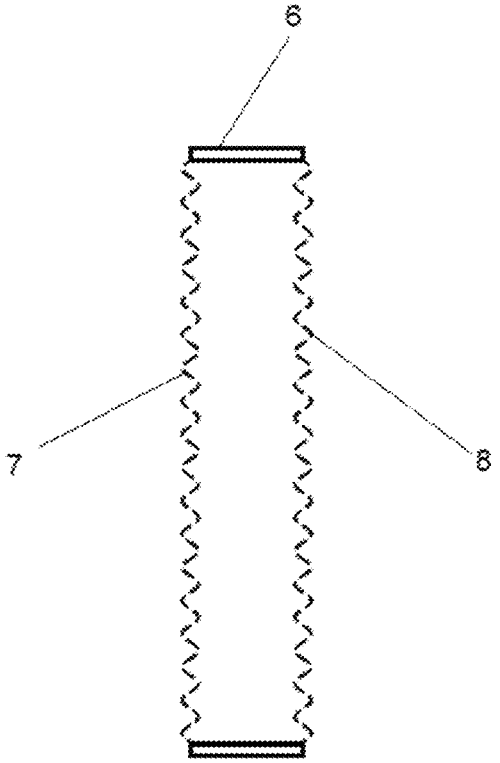
Figure 5:
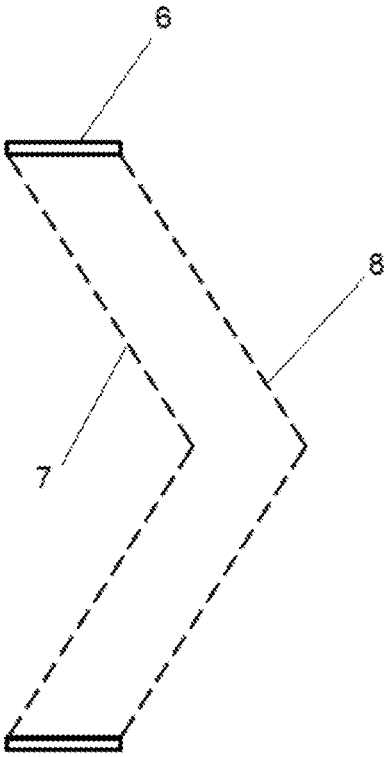
Figure 6:
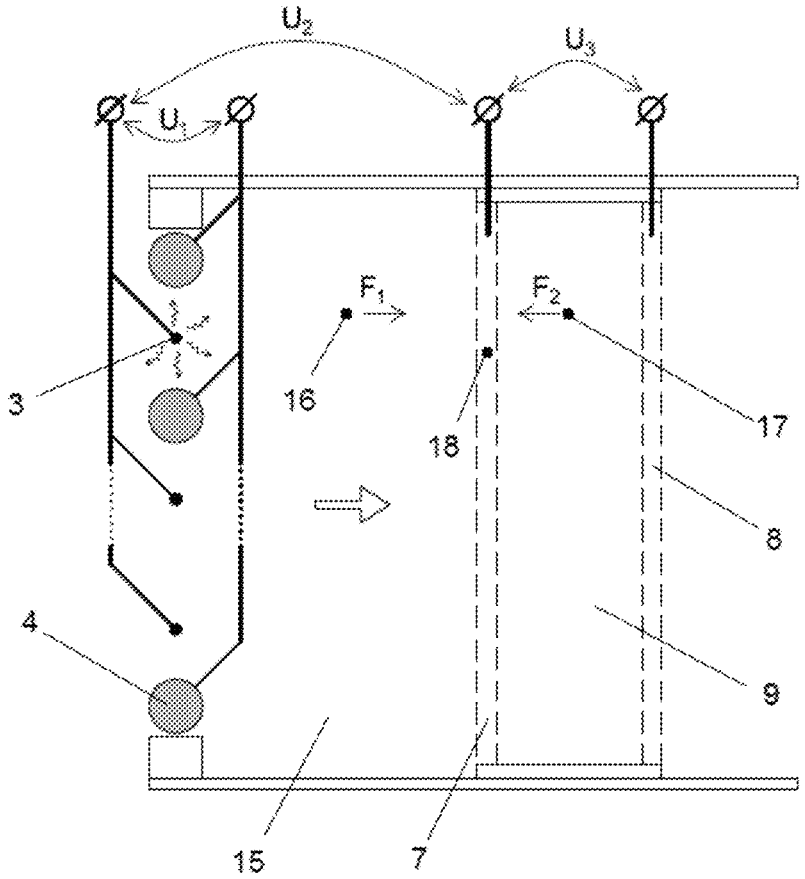
Figure 7:
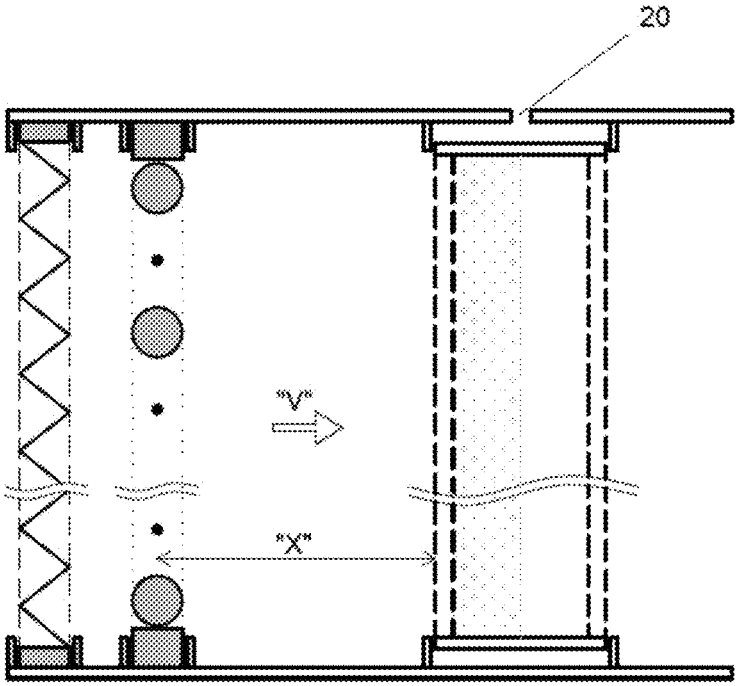
Figure 8:
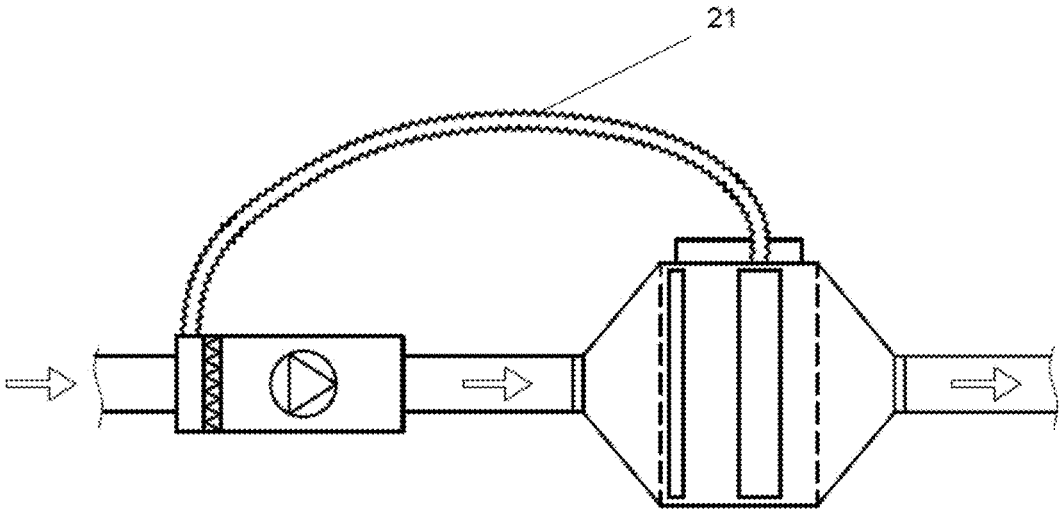

Embodiments of the air filter according to the invention are presented in the drawing, where:

FIG. 1 presents schematically a longitudinal cross-section in a side view of a fragment of the air flow channel of the filter according to the first embodiment of the invention;

FIG. 2 presents schematically a set of corona electrodes and cumulative electrodes of the filter according to the second embodiment of the invention;

FIG. 3 presents schematically a longitudinal cross-section in a top view of a fragment of the flow channel of FIG. 1, along with a pre-filter and a supply fan;

FIGS. 4 and 5 present other embodiments of the input and output electrodes;

FIG. 6 illustrates the operating principle of the filter according to the invention, presenting the potential differences and electric field strength vectors in the individual areas of the filter;

FIG. 7 presents schematically a longitudinal cross-section in a side view of a fragment of the air flow channel of the filter according to another embodiment of the invention;

FIG. 8 presents schematically a longitudinal cross-section in a top view of a fragment of the air flow channel from the filter according to another embodiment of the invention.

Figure 9:
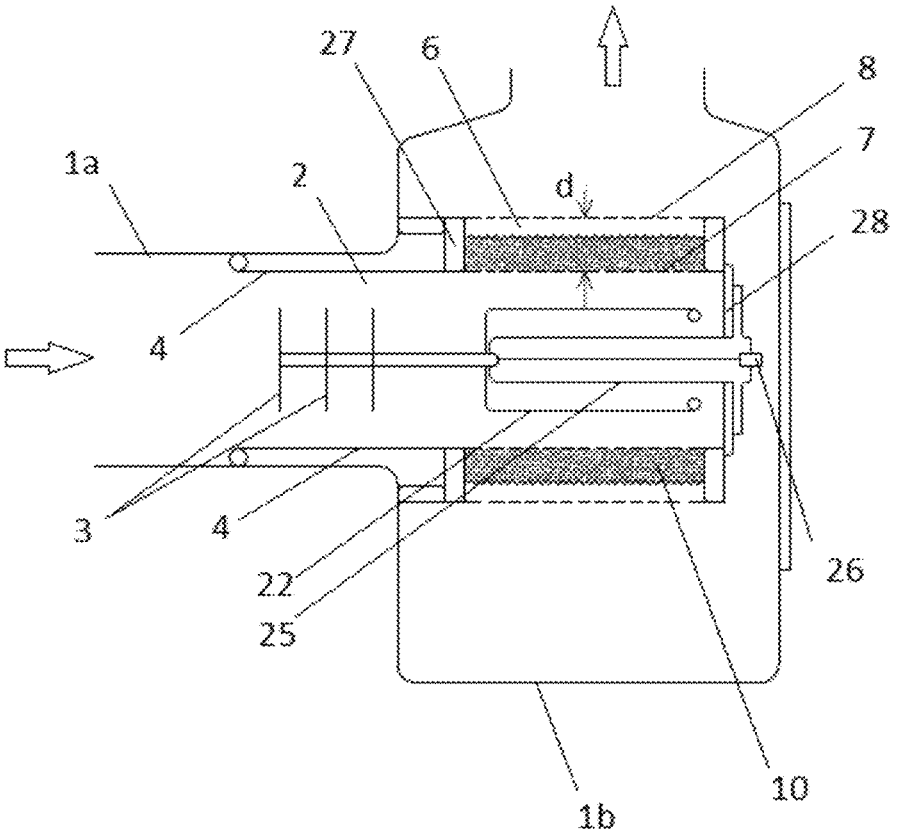
Figure 10:
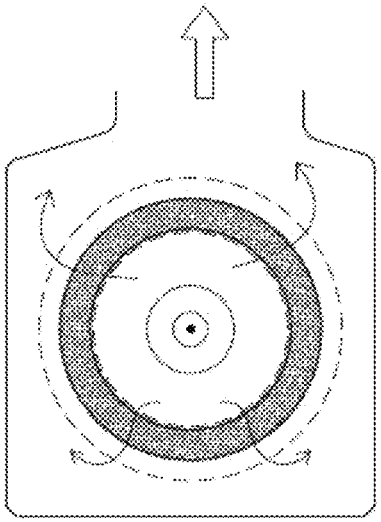
Figure 11:
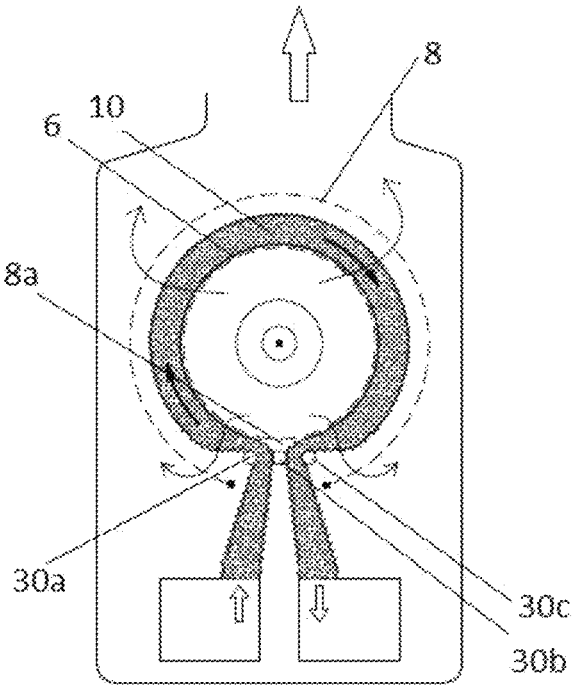

FIG. 9 presents schematically a longitudinal cross-section of the air flow channel from the filter according to yet another embodiment of the invention;

FIG. 10 presents schematically a transverse cross-section of the filter of FIG. 8 in an embodiment with an immobile filtering layer;

FIG. 11 presents schematically a transverse cross-section of the filter of FIG. 8 in an embodiment with a mobile filtering layer;

As shown in FIG. 1, the filter according to the invention comprises an air flow channel 1, preferably constituting a filter housing, having an air inlet and an air outlet. The inlet and the outlet are not shown in the figures, but it is to be understood that the inlet is placed at the left side of the channel and the outlet is placed at the right side. The arrow indicates the air flow direction. In the air flow channel 1, at the inlet side an ion generator 2 is located, comprising in this embodiment a set of three corona electrodes 3 electrically connected to each other and a set of three cumulative electrodes 4 mounted in a rigid insulating frame 5. The electrodes are preferably parallel to each other. The corona electrodes 3 may be made, e.g. of a thin metal wire with a diameter of 0.1-0.5 mm, while the cumulative electrodes 4 are preferably made of conductive tubes or rods with an adequately large diameter, e.g. in the order of 5-30 mm.

Downstream of the ion generator 2 in the flow channel 1 there is a separator of contaminant particles 6, comprising an input electrode 7 and an output electrode 8. The electrodes 7 and 8 have a construction enabling the air to flow through them in a direction from the input electrode 7 towards the output electrode 8 and further to the channel outlet. Both electrodes 7 and 8 are made from an electro-conductive material, or a material with proper electric conductivity enabling the dissipation of electrostatic charges accumulated thereon. Preferably, the input electrode 7 and the output electrode 8 are made of metal and can have the form of a mesh or a perforated plate. The input electrode 7 or/and the output electrode 8 may also be made of conductive nonwoven or a spongiform material, preferably coated with activated carbon.

An additional filtering layer 10 of an electrically nonconductive material, e.g. with a nonwoven or spongiform structure, may be located in the space 9 between the electrodes 7 and 8. In the case where nonconductive particles are being filtered, the filtering layer 10 may fill the whole space 9 between the electrodes 7 and 8. In the case of filtering conductive particles, for example coal soot, electrically insulating air space should be preferably maintained between the filtering layer 10 and the output electrode 8.

Both the ion generator 2 and the separator 6 are mounted in respective guides 11 enabling removal of these elements from the housing for servicing purposes, and at the same time providing proper tightness.

FIG. 2 presents another embodiment of a set of corona electrodes 3 and cumulative electrodes 4. In this second embodiment, the cumulative electrodes 4 are placed in a plane parallel to the plane of the set of the interconnected corona electrodes 3, and they are placed upstream of these electrodes. The cumulative electrodes 4 should be mounted separate in relation to the corona electrodes 3 in order to enable their independent servicing. Similar to FIG. 1, the arrows indicate the air flow direction.

FIG. 3 presents the filter in a longitudinal cross-section. The filter according to the invention is connected to a high voltage source; alternatively, it comprises such a source. Preferably, for powering and controlling the operation of the filter, a high voltage generator and a controller determining the operating conditions of the device are mounted outside its housing. These elements are not shown in the drawing.

Optionally, an air pre-filter 12 for mechanical separation of contaminant particles may be placed upstream of the ion generator 2. If the filter according to the invention is mounted in a ventilation system downstream of the air handling unit, then the pre-filter 12 is not necessary.

The filter housing according to the invention is adapted to being connected to a channel-based ventilation system downstream of the pre-filter 12 and the fresh air supply fan 13, as seen in FIG. 3. Therefore, the ion generator 2 and the separator 6 are placed in a sealed housing with two-way connector spigots suitable for a specific use. The mounting of the generator 2 and the separator 6 in the housing should be properly sealed, but it should enable their removal from the housing. Additionally, elements 14 for equalising the air flow over the whole cross-section of the filter, e.g. in the form of air control blades, mesh diffusers, etc. are preferably mounted in the housing. The uniform flow of air over the whole cross-section increases the filtration efficiency of the device.

FIGS. 4 and 5 present other embodiments of the electrodes 7 and 8. They can be made with embossments or folds which increase the rigidity of construction (FIG. 4), and/or in the form of segments situated obliquely i.e. at a certain angle (FIG. 5) with respect to each other. The segmented construction of the electrodes 7 and 8 (like in FIG. 5) increases the active surface of the additional filtering layer 10 of the separator.

FIG. 6 illustrates the operating principle of the filter according to the invention. During the operation of the filter, corona discharges occur between the corona electrodes 3 and the cumulative electrodes 4, causing the ionisation of contaminant particles present in the air flowing through the flow channel 1.

The corona electrodes 3 carry high voltage relative to the cumulative electrodes 4, the high voltage being created by the high voltage generator. The potential difference U1 between the corona electrodes 3 and the cumulative electrodes 4 may be adjusted and it preferably ranges between 2 and 80 kV.

Various embodiments of potentials between the corona electrodes 3, the input electrodes 7 and the output electrodes 8 are possible. The point is that the electric field strength vector in the space 9 (between the input electrode 7 and the output electrode 8) should be directed opposite to the electric field strength vector in the space 15 (between the generator 2 and the input electrode 7), so that the forces generated by these fields would cause acceleration of the charged particles in the space 15 and slowing down in the space 9.

In the first embodiment, the potential of the corona electrodes 3 and the output electrode 8 is positive, while the potential of the input electrode 7 equals zero.

In the second embodiment, the potential of the corona electrodes 3 and the output electrode 8 is positive, but the potential of the input electrode 7 is negative.

In the third embodiment, the potential of the corona electrodes 3 and the output electrode 8 is negative, while the potential of the input electrode 7 equals zero.

In the fourth embodiment, the potential of the corona electrodes 3 and the output electrode 8 is negative, but the potential of the input electrode 7 is positive.

In the fifth embodiment, the potential of the corona electrode 3 is positive, the potential of the input electrode 7 it is negative, and for the output electrode 8 it equals zero.

In the sixth embodiment, the potential of the corona electrode 3 is negative, the potential of the input electrode 7 it is positive, and for the output electrode 8 it equals zero.

In the case of the first and second embodiment, i.e. with positive polarisation of the corona electrodes 3, the emission of ozone is lower than for negative polarisation.

Due to the impact of the corona discharge phenomenon, the air flowing through the ion generator 2 becomes saturated with positive or negative ions created as a result of corona discharges, depending on the adopted polarisation of the corona electrodes 3. These ions transfer the electric charge to any contaminants present in the flowing air. The corona discharge occurs virtually only on corona electrodes 3.

In the ion generator 2, partial deposition of only a slight amount of contaminant particles occurs on cumulative electrodes 4, on which between approximately 9% and approximately 10% of particles are deposited. Most of the charged particles 16 flow on, to the separator of contaminant particles 6.

Upon leaving the ion generator 2, the air comprising electrified particles of contaminants 16, while flowing through the space 15 between the ion generator 2 and the input electrode 7, becomes affected by strong electric field generated by the potential difference U2 between the corona electrodes 3 and the input electrode 7 of the separator 6.

As mentioned above, the potential of the input electrode 7 may equal zero (the electrode is earthed), or more preferably it is of an opposite sign in relation to the corona electrodes 3. The electrical voltage U2 between the corona electrodes 3 and the input electrode 7 is adjustable and it may range between approximately 3 kV and approximately 50 kV. The value of this voltage depends on the distance between the electrodes 3 and 7, the amount of eliminated contaminants and the required efficiency of filtration. The input electrode 7 through which the air flows is made of metal or a material with proper electrical conductivity enabling the dissipation of the electrical charge accumulated thereon, and it can have the form of a mesh, perforated plate or/and conductive nonwoven material, preferably comprising activated carbon. In the space 15 between the ion separator 2 and the input electrode 7 additional ionisation of air occurs, caused by the existence of an electric field; charged contaminant particles 16 subjected to this field are accelerated by the action of the electrostatic force F1, and due to numerous collisions they can additionally electrify other neutral or oppositely charged solid or fluid particles. In this manner, the number of charged particles increases, but this is no longer a direct result of the corona discharge. Upon reaching the input electrode 7 of the separator 6, the majority of particles 16 are electrostatically deposited on its surface and on an additional filtering layer 10, e.g. of a conductive nonwoven material (if present). A part of the solid particles flows with the air into the space 9 between the input 7 and output 8 electrodes. This space, along with the electrodes 7 and 8, constitutes a kind of an electrical capacitor, in which strong electric field is generated due to the impact of the potential difference U3 of electrodes 7 and 8, the electric field having a strength vector directed opposite to the electric field strength vector in the space 15, causing the charged particles 17 and gaseous ions present in the space 9 to stop due to the action of the electrostatic force F2. Because of this, the stopped particles 18 are deposited on the input electrode 7 and possibly on an additional filtering layer 10. The presence of the additional layer 10, e.g. of nonwoven material, increases the efficiency of filtration considerably. The voltage U3 between the input electrode 7 and the output electrode 8 may range from a few to several tens kilovolts. Both the input 7 and the output 8 electrode may also comprise a layer with activated carbon. This may have the form of a nonwoven material, a sponge of carbon granules. The activated carbon decreases the amount of harmful gases and smells, also reducing the trace ozone and nitrogen oxides created in the generator 2. Very precise separation of virtually all solid particles and aerosols takes place in the additional filtering layer 10 of the separator 6.

The corona electrodes 3 are placed at a technological distance X from the input electrode 7, the distance being adapted to the value of the potential difference U2 between the corona electrodes 3 and the input electrode 7.

The size of the filter is selected so that the speed V of air flowing through the separator 6 would range between 0.2 m/s and 3 m/s. For such a speed range, pneumatic resistances of the whole filter are relatively low and range between 10 and 150 Pa. The lower the flow rate, the more efficient the filtration for the given electrical power.

In a case when the pre-filter 12 is placed upstream of the ion generator 2, mechanical separation of large particles exceeding approximately 0.5 mm proceeds therein.

As explained above, the specific feature of the whole process as compared to other encountered solutions also involves the fact that a relatively small corona discharge is sufficient for successful filtration. The separator 6 enables very efficient use of the removed ion particles generated during corona discharges in the ion generator 2 for electrification. Due to this, the electrical charge emitted during the corona discharge, which is necessary for efficient deposition of particles, is considerably lower. As a consequence, the deposition of particles on the electrode 7 and in particular in the filtering layer 10 requires an amount of energy which is much lower compared to known solutions. For successful filtering, typical electrostatic filters need very high saturation of air with ions, and besides this there is a need for stronger corona discharges and power of supplied electrical energy.

In practice, the achieved efficiency of removing from the air the particles of a diameter between 0.1 and 100 μm amounts to 99.97%. At the same time, ozone emission is considerably below 50 μg in 1 $m^3$ of the air flowing through the filter (the allowable ozone emission is 120 $\mu g/m^3$).

FIG. 7 presents another preferable embodiment of the filter according to the invention, in which in the channel housing 1, between the guides 11 in which the separator 6 is seated, there is an opening 20 connecting the space between the guides 11 and the separator 6 with the external surroundings. If the filter is mounted downstream of the supply fan 13, as shown in FIG. 3, then in the case of a leakage in the space around the separator 6 and between the guides 11 in which it is seated, there is always a pressure lower than in the channel 1. It is advantageous as it prevents the unfiltered air from entering the filter outlet. The opening 20 additionally facilitates venting unfiltered air from this space. FIG. 7 presents one sample opening 20; however, more openings may be provided, both above the separator 6 and below it.

As shown in FIG. 8, the air leaving the opening (or openings) 20 may be additionally directed to the upstream side of the fan 13 by means of a ventilation duct 21 with a small cross-sectional area.

The filter according to the invention combines the features of two filtration methods, i.e. the electrostatic filtration and the filtration of so-called "absolute" mechanical nonwoven filters. Its advantages include:

- very high efficiency (above 99.5%) of filtering solid particles and aerosols, even below 10 microns;
- sterilisation of air;
- considerable decrease in the amount of harmful gases, such as benzopyrenes and other aromatic compounds, formaldehyde, as well as unpleasant smells;
- very high absorbability of the filter, which decreases the frequency of maintenance;
- relatively low hydraulic resistances compared to other mechanical absolute filters;
- compact construction; the length of the whole filter may be limited to just 7-10 cm;
- very low consumption of electrical energy, in the order of 8-20 Wh per 1000 $m^3$ of air;
- in the embodiment with openings in the housing—elimination of the problem of the unfiltered air from the inside of the housing entering the filter outlet.

FIGS. 9, 10 and 11 present another embodiment of the electrostatic filter according to the invention. In these embodiments, the input electrode 7 and the output electrode 8 have a cylindrical shape, so that the output electrode 8 surrounds the input electrode 7. Moreover, the corona electrodes 3 are preferably placed in series and they have the form of discs, while the potential difference between the corona electrodes 3 and the cumulative 4 electrodes is preferably higher than in the preceding embodiments, and ranges between 5 kV and 80 kV. Placing the corona electrodes 3 in series is preferable for high concentrations of contaminants, since the effect of the so-called throttling of the outflow is diminished, and thus the emission of ions is increased.

In these embodiments, the corona electrodes 3, carrying high voltage, are placed on a bushing insulator 25 and preferably in an additional shield 22, also constituting an amplifier of the electric field between the shield 22 and the input electrode 7 of the particle separator 6. In this manner, the electrical insulators of the corona electrodes 3 are protected against too rapid contamination. Electro-conductive contaminations, e.g. soot, deposited on the insulator 25, are disadvantageous, since they cause a drop in the electrical strength of the insulator, generation of harmful leakage currents and discharges on the surface of the insulator.

High voltage is supplied to the contact 26 and to the corona electrodes 3 via the insulator 25. The shield 22, having the same electrical potential as the corona electrodes 3, protects the insulator 25 against contaminated air. In the embodiments of FIGS. 9-11, the cumulative electrode 4 of the ion generator 2 is electrically connected to the input electrode 7 of the separator 6. Preferably, they are also connected to each other mechanically, or they are made as one element. Electrodes 4 and 7 are connected to the channel housing 1 in a manner enabling their disconnection. They are not electrically insulated from the channel housing 1. These electrodes have an approximately "zero" or almost zero potential in relation to the channel housing 1.

The whole separator 6 is seated along with the insulator 25, the shield 22 and the corona electrodes 3 in the bottom 28. The connection of the separator 6 to the bottom 28 should be tight along the whole perimeter. Everything is placed in the air flow channel housing 1 consisting generally of two parts:

- part 1*a*, preferably round, adjusted geometrically to the source of the contaminated gases, for instance a chimney flue;

part 1*b*, being a chamber for the separator 6 (and in the embodiment of FIG. 9 described below, also for a clean and used filtering layer 10);

a flange 1*c* with a shape adapted to the channel venting the purified gases.

Such realisation of the filter according to the invention enables easy periodic removal of the whole system of the separator 6 and ion generator 2 from the housing through a service cover (not shown). Upon disassembling the output electrode 8, it is possible to replace the filtering layer 10, clean the electrodes 3 and all the electrically insulating elements.

In FIGS. 9 and 10 the input 7 electrode and the output 8 electrode have the shape of full cylinders, preferably made of a mesh or perforated sheet metal. The input electrode 7 has a transverse cross-section of a circular or alternatively oval shape. The output electrode 8 has a cross-section of a shape depending on the shape of the input electrode 7 and it is placed apart from it at a distance "d" by means of distancing insulating elements 27. The potential of the electrode 8 in relation to that of the electrode 7 is a so adapted that it makes the electrostatic force acting on the electrified particles constantly opposite to their speed vector in order to stop them and to cause deposition of the contaminations on the filtering layer 10. The filtering layer 10 placed between the electrodes 7 and 8 is made of a nonwoven material or a sponge made of a material adapted to withstand the temperature of the filtered gases and it has a shape adapted to the shape of the electrodes 7 and 8; preferably it is placed at a certain distance from the output electrode 8.

In the case of the gases with a very high solid particle contents exceeding 10 mg/m$^3$, it is preferable for the filter housing according to the invention to enable repeated removal of the contaminated filtering layer 10 from the area of operation and its replacement with a clean filtering layer. Repeated replacement of the layer 10 considerably extends the time of uninterrupted operation of the filter.

FIG. 11 presents a transverse cross-section of the filter according to the invention in an embodiment with a mobile filtering layer 10. In this embodiment, the input electrode 7 is rotary and mounted on a rotary bottom 28, while the stationary output electrode 8 comprises a slit 8*a*. The filtering layer 10 has the form of a long tape which moves on the mobile rotating input electrode 7. By means of a system of rollers 30*a*, 30*b*, 30*c*, the layer 10 is at one side wound onto the input electrode 7 and, upon an almost full rotation of the electrode 7, it is unwound from it and removed outside the operating area of the filter. The electrode 7 is driven by the rotary bottom 28 on which it is mounted. The rotational speed is adapted to the level of dustiness of the gas.

The rollers 30*a*, 30*b*, 30*c* should be made of an electrically insulating material and they should have a separate driving mechanism synchronised with the drive of the bottom 28.

The slit 8*a* of the output electrode 8 enables, on the one hand, the introduction of a clean layer 10 into the mobile input electrode 7, and on the other hand, the removal of a used layer 10 from the separator 6. The mobile electrode 7 moves the layer 10 along its circumference. The drive system rotating the bottom 28 and the whole high voltage system are not shown in the figures.

Embodiments of the filter according to the invention presented in FIGS. 9-11 enable their use in the purification of air having a high temperature and/or very high solid particle content. Apart from ventilation applications they can be used to purify the exhaust fumes of internal combustion engines, especially diesel, the exhaust fumes of solid fuel heating boilers, welding fumes, in fire fighting in combination with fans for temporary improvement of visibility and for rescuing people. The solid particle content at the inlet may amount to even 100 000 μg/m$^3$ and more. This filter is also characterised by a relatively low emission of the harmful ozone. In the embodiment with a moveable separator 6, the filter can work uninterruptedly for a very long time.

The invention claimed is:

1. An electrostatic air filter configured to be connected to a high voltage source, comprising:

an air flow channel having an inlet and an outlet, an ion generator disposed at a side of the air inlet, the ion generator comprising at least two corona electrodes and at least two cumulative electrodes, the at least two corona electrodes being electrically connected to each other and the at least two cumulative electrodes being electrically connected to each other, and all of the at least two cumulative electrodes being insulated from all of the at least two corona electrodes, such that corona discharges may occur between the at least two corona electrodes and the at least two cumulative electrodes due to a first potential difference, causing ionization of contaminant particles present in air flowing through the air flow channel, a separator of contaminant particles is located downstream of the ion generator in the air flow channel, the separator comprising an input electrode and an output electrode spaced apart from the input electrode, the input and output electrodes enabling flow of air therethrough in a direction away from the input electrode towards the output electrode and further to the air flow channel outlet, wherein during operation of the air filter, a second potential difference exists between the at least one corona electrode and the input electrode, and a third potential difference exists between the input electrode and the output electrode, such that an electric field strength in a space between the input electrode and the output electrode is directed opposite to an electric field strength in a space between the ion generator and the input electrode;

wherein the corona electrodes, the cumulative electrodes, the input electrode, and the output electrode are constructed such that during operation of the air filter corona discharge occurs virtually only on the corona electrodes of the ion generator.

2. The air filter according to claim 1, wherein the input electrode and the output electrode have a cylindrical shape, and are disposed such that the output electrode surrounds the input electrode.

3. The air filter according to claim 1, wherein the input electrode comprises a conductive nonwoven or a spongiform material, optionally coated with activated carbon.

4. The air filter according to claim 1, further comprising a filter layer comprising a material with low electrical conductivity located in the space between the input electrode and the output electrode.

5. The air filter according to claim 1, wherein a potential of the at least two corona electrodes and the output electrode is positive, and a potential of the input electrode equals zero.

6. The air filter according to claim 1, wherein a potential of the at least two corona electrodes and the output electrode is positive, and a potential of the input electrode is negative.

7. The air filter according to claim 1, wherein a potential of the at least two corona electrodes and the output electrode is negative, and a potential of the input electrode equals zero.

8. The air filter according to claim 1, wherein a potential of the at least two corona electrodes and the output electrode is negative, and a potential of the input electrode is positive.

9. The air filter according to claim 1, wherein a potential of the at least two corona electrodes is positive, a potential of the input electrode is negative, and a potential of the output electrode equals zero.

10. The air filter according to claim 1, wherein a potential of the at least two corona electrodes is negative, a potential of the input electrode is positive, and a potential of the output electrode equals zero.

11. The air filter according to claim 1, wherein the air flow channel constitutes a filter housing, in which the ion generator and the separator are assembled in a manner which is tight and enables disassembly of the ion generator and the separator for servicing purposes.

12. The air filter according to claim 1, further comprising guides between which the separator is seated, and at least one opening defined in the channel between the guides, the at least one opening connecting the space between the guides and the separator to external surroundings.

13. The air filter according to claim 1, further comprising a pre-filter upstream of the ion generator for mechanical separation of contaminant particles.

14. The air filter according to claim 1, wherein the first potential difference is adjustable and ranges between 2 and 80 kV.

15. The air filter according to claim 1, wherein the second potential difference is greater than the first potential difference.

16. The air filter according to claim 1, wherein the input electrode and/or the output electrode have a form selected from a group comprising a mesh, perforated sheet metal, a surface with ribs or folds, and segments situated at an angle with respect to each other.

17. The air filter according to claim 1, wherein the third potential difference is adjustable and ranges between 2 and 50 kV.

18. The air filter according to claim 2, wherein the at least two corona electrodes are connected to each other in series.

19. The air filter according to claim 2, wherein the at least two corona electrodes, comprising at least one disc, are placed on an insulator located in a shield.

20. The air filter according to claim 4, wherein the input electrode is rotary, the output electrode comprises a slit, and an insert of the filter layer is movable on a surface of the input electrode, and has ends extending through the slit.

* * * * *